US006899336B2

(12) United States Patent
Michelet et al.

(10) Patent No.: US 6,899,336 B2
(45) Date of Patent: May 31, 2005

(54) OUTDOOR GAME APPARATUS

(75) Inventors: Donald Peter Joseph Michelet, Norwich (CA); Marilyn Louise Michelet, Norwich (CA); Lawrence Wesley Johnson, Burgessville (CA); Alie Johnson, Burgessville (CA); Gary Edward Pite, Scotland (CA); Michael Joseph DeRudder, Tillsonburg (CA); Louise Elaine DeRudder, Tillsonburg (CA)

(73) Assignee: Pour Me Ideas Inc., Scotland (CA)

( * ) Notice: Subject to any disclaimer, the term of this patent is extended or adjusted under 35 U.S.C. 154(b) by 0 days.

(21) Appl. No.: 10/757,563

(22) Filed: Jan. 15, 2004

(65) Prior Publication Data

US 2004/0147345 A1 Jul. 29, 2004

(30) Foreign Application Priority Data

Jan. 23, 2003 (GB) ..... 0301523
Aug. 29, 2003 (GB) ..... 0320286

(51) Int. Cl.[7] ..... A63B 67/06
(52) U.S. Cl. ..... 273/400; 273/342
(58) Field of Search ..... 273/398–402, 273/336, 338, 393

(56) References Cited

U.S. PATENT DOCUMENTS

| | | | | | |
|---|---|---|---|---|---|
| 61,960 | A | | 2/1867 | Snofford et al. | |
| 300,097 | A | | 6/1884 | McAllister | |
| 970,901 | A | | 9/1910 | Ernst | |
| 1,649,740 | A | | 11/1927 | Rott | |
| 1,970,249 | A | | 8/1934 | Prisciantelli | |
| 2,506,932 | A | | 5/1950 | McAfee | |
| 2,520,392 | A | | 8/1950 | Flenghi | |
| 3,428,319 | A | * | 2/1969 | Engle | 273/393 |
| 3,612,532 | A | * | 10/1971 | Strongin | 273/354 |
| 3,734,503 | A | | 5/1973 | Breslow | |
| 3,774,912 | A | | 11/1973 | Glass et al. | |
| 3,862,758 | A | | 1/1975 | McLamb | |
| 3,873,091 | A | | 3/1975 | Katzman et al. | |
| 3,892,407 | A | * | 7/1975 | Higgins | 273/336 |
| 4,127,271 | A | | 11/1978 | Moutakas | |
| 4,245,842 | A | | 1/1981 | Kuna et al. | |
| 4,330,130 | A | | 5/1982 | Carr | |
| 4,350,344 | A | | 9/1982 | Bear | |
| 4,378,944 | A | | 4/1983 | Johnston | |
| 4,386,779 | A | * | 6/1983 | Whitlock | 273/336 |
| 4,453,713 | A | | 6/1984 | Guyer | |
| 4,736,955 | A | | 4/1988 | Pollock | |
| 5,052,693 | A | * | 10/1991 | Hicks | 273/336 |
| 5,067,727 | A | * | 11/1991 | Crompton | 273/336 |
| 5,265,884 | A | * | 11/1993 | Stein | 473/570 |
| 5,282,635 | A | * | 2/1994 | Hopkins | 273/342 |
| 5,620,185 | A | * | 4/1997 | Robertson | 273/338 |
| 5,882,010 | A | * | 3/1999 | Geror | 273/400 |
| 6,749,201 | B2 | * | 6/2004 | Kessler et al. | 273/400 |

* cited by examiner

*Primary Examiner*—Mark S. Graham
(74) *Attorney, Agent, or Firm*—Anthony Asquith Corp.

(57) ABSTRACT

In the game, missiles are pitched by hand at a target. The target is in the form of an enlarged bottle-cap, which resides on top of a bottle. The bottle is secured in the center of a bowl. The missiles are identical to the enlarged cap.

18 Claims, 5 Drawing Sheets

OUTDOOR GAME APPARATUS

This invention relates to an outdoor game apparatus, which involves pitching or throwing missiles at a target.

BACKGROUND TO THE INVENTION

Pitching games are traditionally popular. Many of the known games involve the use of apparatus that must be permanently installed, whereby the game can only be played at a particular place—the game of horse-shoes, for example. The invention is aimed at providing a game apparatus that is portable.

Of the traditional pitching games in which the apparatus can be packed e.g into the trunk of a motor vehicle, many include loose or unattached pieces (including the missiles to be pitched), which can become separated from the rest of the apparatus, and lost. An aim of the present invention is to provide the apparatus in such manner that separation and loss of the loose pieces, though not eliminated as an accidental possibility, is rendered unlikely.

It is an aim of the invention to provide a game apparatus that is portable, and light in weight, overall, such that it can be easily carried, and lifted into and out of a vehicle. Furthermore, the apparatus should be portable in the sense that a person can easily carry all the apparatus in one package; it would be a disadvantage of the apparatus were separated into two or more packages, which might become separated.

Furthermore, it is an aim that it should be possible for a person, simply by casually viewing the package, to check that all the required pieces of the apparatus are present. Furthermore, it is an aim that no carrying-box be required, in that preferably the game apparatus itself serves as a receptacle for keeping the loose pieces together when the apparatus is not in use. Furthermore, it is an aim that the game apparatus be made of materials that can be left out in all weathers.

It is an aim of the invention that the game be a game of skill, in that persons with skill in pitching missiles can expect to win most of the time, and also in that players can improve their skills by practice. The occasional lucky hit means even an unskilled first-time player can be interested in playing the game—but still, the aim is to provide the apparatus in such manner that a lucky hit is the equivalent of pitching skill, not the equivalent of nudging the apparatus.

Pitching games in which the missiles are loose have the disadvantage that the missiles might become separated and lost. (Games in which the missiles are tethered have of course been proposed, but the flight of the missiles in such games is so un-intuitive that the games have not found favour, especially not as outdoor games.) It is recognised that, preferably, all the pieces that are loose should be the same, such that if any one piece is lost the game can still proceed with only slight disadvantage. It is an aim, also, that the loose pieces should be large, in the context that it is harder to lose large pieces than small pieces.

In addition, the invention is aimed generally at providing a game apparatus of a sturdiness and robustness that is in keeping with the intended use, and which is simple and inexpensive to manufacture. Aspects of the apparatus having to do with actually playing the game are described below.

GENERAL FEATURES OF THE INVENTION

The game apparatus of the invention preferably includes a bowl-shaped receptacle, suitable for resting on the ground.

The apparatus preferably includes a post, preferably in the form of a bottle, having a top rim, and includes a cap, and missiles. The post is attached to the floor of the bowl, and lies in an upstanding configuration with respect to the floor.

Preferably, the post includes a top rim, and the cap is suitably structured for engagement with, and removal from, the top rim of the post. One of the top rim of the post and the undersurface of the cap is formed with a stud, and the other is formed with a corresponding recess, and the arrangement of the apparatus is such that the stud and the recess are brought into mutual engagement upon the cap being engaged with the top-rim of the post. The nature of the engagement of the stud with the recess is such that cap is substantially not able to be knocked off the post by the missile unless struck forcefully and directly by the missile.

DETAILED DESCRIPTION OF PREFERRED EMBODIMENTS

By way of further explanation of the invention, exemplary embodiments of the invention will now be described with reference to the accompanying drawings, in which:

FIG. 1 is a pictorial view of a bowl and bottle component of a game apparatus that embodies the invention.

FIG. 2*a* is a pictorial view from above, and FIG. 2*b* is a pictorial view from underneath, of a cap component of the game apparatus.

The apparatuses shown in the accompanying drawings and described below are examples which embody the invention. It should be noted that the scope of the invention is defined by the accompanying claims, and not necessarily by specific features of exemplary embodiments.

Figure 2:
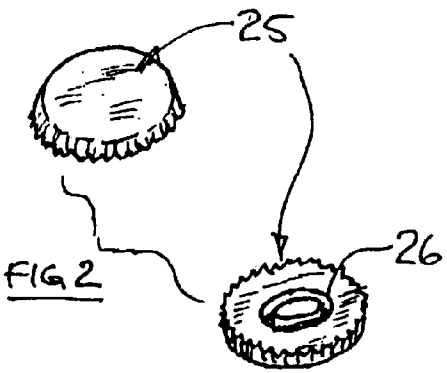
Figure 1:
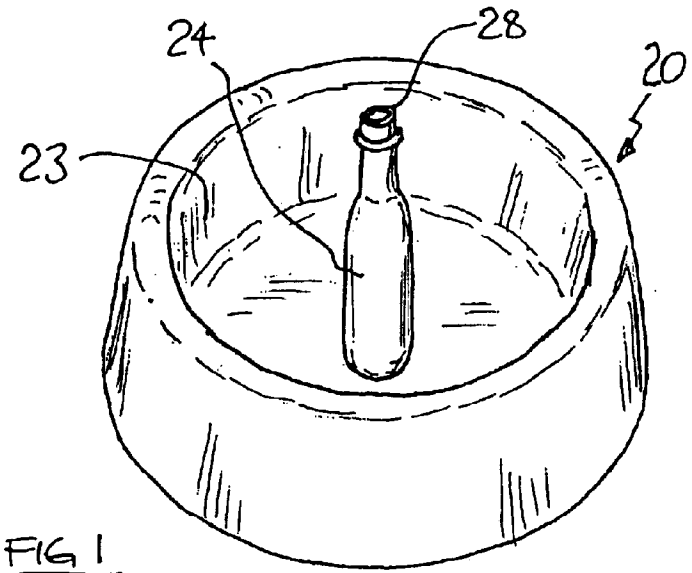

FIGS. 1,2 show the apparatus 20 as used in the game. The apparatus includes a bowl 23, in which is attached a bottle 24. The apparatus also includes a cap 25. In fact, the apparatus includes several of the caps 25, which are generally identical. One of the caps is placed on top of the bottle 24, and forms the cap of the bottle. The rest of the caps 25 serve as missiles.

The basic idea of the game is to knock the cap 25 off the bottle 24. Each player has e.g three missiles per round, and attempts to knock the cap off the bottle.

The cap 25 does not simply rest on top of the bottle 24. That would be too fragile a manner of supporting the cap, whereby the cap would be too easily knocked off, or might fall off unintentionally. The game would not be so engrossing if the cap were to fall off too easily.

The manner of attaching and supporting the cap with respect to the bottle is arranged, in the apparatus 20, such that the missile actually has to strike the cap, quite hard, in order for the cap to fall. A marginal or glancing strike might not be enough to dislodge the cap. This is what is intended. The intention is to provide a manner of attaching and supporting the cap such that the cap remains attached to the bottle with sufficient tenacity that it takes a direct forceful strike to knock it off.

At the same time, the intention is to provide a support and attachment system whereby it is easy for a person to set the cap on top of the bottle—and whereby it is easy for the person to achieve the required degree of tenacity of attachment, just by the action of setting the cap on the bottle.

To this end, a recess 26 has been provided in the undersurface 27 of the cap 25, and the configuration of the recess, and its relationship with the top of the bottle, will now be described.

The cap 25 is preferably of moulded plastic, and is around seven centimeters diameter, is one cm thick, and weighs around a hundred grams. The recess 26 in the undersurface 27 is preferably about two and a half centimeters diameter, and three millimetres deep. Of course, the designer should set the dimensions of the recess 26 in accordance with the dimensions of the top of the bottle 24.

The recess 26 is slightly conical. This shape is good from the moulding draft-angle standpoint, and also, the tapered shape of the recess means that the cap can be very easily located on the top of the bottle. Thus, a player setting the cap on the bottle can very easily line up the recess to the top rim 28 of the bottle, the recess being loose over the bottle during initial lining up. Then, once the cap is aligned on top of the bottle, the player can very easily press down on the cap, for a moment, and cause the cap to become slightly tight on the bottle.

It has been found that this level of fit is highly suited to the game. It is almost impossible for a player to put the cap on the bottle either so tightly or so loosely that it would spoil the game. This is true even when the player approaches the task very casually. It is also the case that a person placing the cap on the bottle knows instantly the difference between placing the cap properly and improperly—i.e improperly in the sense of misaligning the cap 25 such that the recess 26 is not lined up with the top rim 28 of the bottle 24.

On the other hand, the manner as illustrated by which the cap is secured to the bottle enables the addition of a little variety to the game, in that one player might press the cap 25 on a little more tightly than another player. The variable degrees of tightness are possible without the components being incorrectly positioned or misaligned.

The bottle 24 and bowl 23 form a single assembly, which is robust, yet light in weight. The game apparatus is thus suitable for play at a picnic site, beach, garden, etc. There is no permanent installation. (Other pitching games, such as the game of horseshoes for example, do require a permanent installation.)

Figure 4:
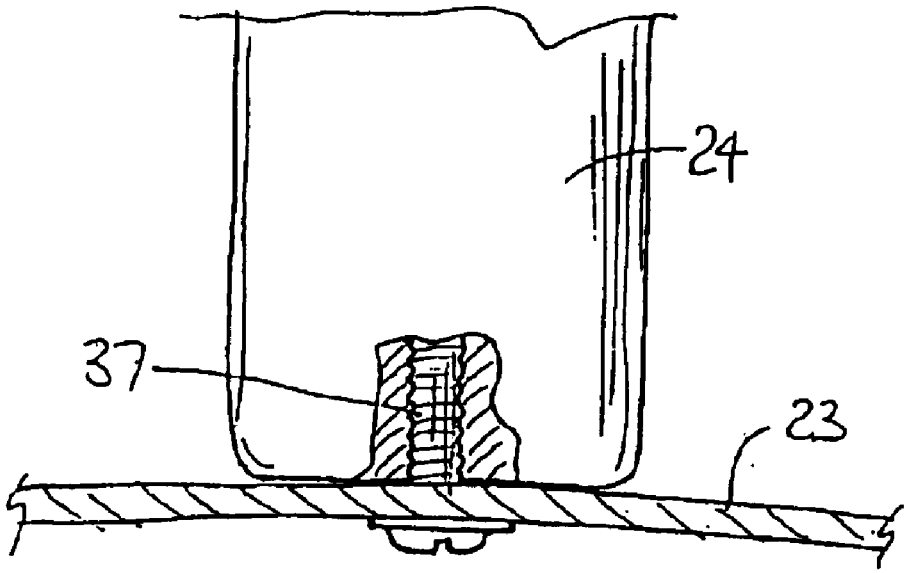
FIG. 4 is a cross-section showing the manner by which the bottle is attached into the bowl.

The bottle 24 is not made of glass. The bottle is formed as a solid (or hollow) plastic moulding, and is secured to the e.g moulded plastic bowl 23 by glue, or a screw 37, or the like, in the manner as indicated in FIG. 4. Alternatively, the bottle shape may be moulded directly into the bowl.

Figure 3:
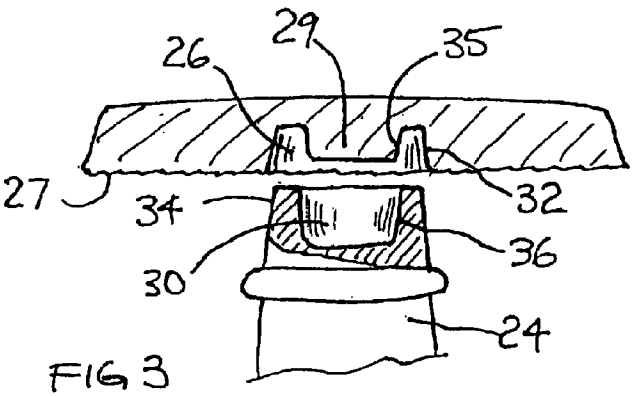
FIG. 3 is a cross-section showing the manner in which the cap fits over the bottle.

The top rim 28 of the bottle is configured to complement the recess 26 in the underside 27 of the cap 25, whereby the cap enters the recess on a male/female basis. In order to get the most advantageous degree of tenacity between the cap and the bottle, we prefer to mould the recess with an inner and an outer surface. As shown in FIGS. 2,3, the recess 26 is annular in shape, whereby a protruding stud or stub 29 is present inside the recess 26. Correspondingly, the top rim 28 of the bottle is moulded as an annular ring, leaving a hollow 30 inside the rim 28.

Preferably, it is arranged that the inside surface 32 of the recess 26 fits against the outside surface 34 of the rim 28, and also that the outside surface 35 of the stub 29 fits against the inside surface 36 of the rim 28. Thus, there are two surfaces that touch when the cap is pressed onto the top of the bottle. The rim diameter D (FIG. 3) is about twenty-five millimetres.

The designer may prefer to omit the stub 29 from the cap moulding. In that case, only the outer surface 34 of the rim would be touching the inside 32 of the recess 26, and in that case, the tenacity with which the cap is held onto the bottle would be less. While that might suffice, it has been found that the degree of tenacity that arises from having both surfaces engaged and touching is preferable, in the game apparatus.

It might be considered that there would be a problem of manufacturing tolerances associated with having the two surfaces in simultaneous engagement. But the cap and bottle preferably are moulded in a slightly pliable type of plastic material, such as PVC for the cap, and high density polyethylene for the bottle. Also, the engaging surfaces are tapered, whereby a degree of misalignment can be accommodated while enabling the surfaces still to be tight.

In the game apparatus as described, the cap 25 is very large relative to the bottle 24. Thus the cap does not, of course, look like a real cap for the bottle. To even a novice player, the fact that the cap is grossly out of proportion to the bottle 24 means that attention is drawn to the cap, and to the fact that the cap is the target, not the bottle.

of course, game apparatuses are known in which what may be termed a cap has to be knocked off what may be termed a post, by a missile. In most of the previous cases, the cap has simply rested on top of the post. In the present game apparatus, the cap is so very much larger than the rim of the bottle that the designer cannot just allow the cap simply to rest on top of the bottle; rather, the designer must provide a means whereby the cap can be secured to the top rim of the bottle.

In the apparatus, the idea of the game is to knock the cap off. But because the cap is snapped onto the post, and is held there with some tenacity, the player must throw the missile so as to strike the cap directly and forcefully. The degree of tenacity is such that it is hardly possible for the cap to be knocked off by an indirect blow, as from a strike to the bottle or bowl. The idea is that such strikes might shake and jar the apparatus, but should not dislodge the cap. The fitting of the cap to the rim of the bottle, in the manner as described, is tight enough that the missile must strike the cap forcefully enough to overcome the tenacity of the grip of the cap to the rim, and it is recognised that this can only be done if the missile hits the cap itself. At the same time, little skill or attention is required, for a person to set the cap on the bottle with this desired degree of grip.

Because of the configuration of the bottle 24 in relation to the bowl 23, a missile aimed at the cap 25, if it just misses, is quite likely come to rest on the bowl-floor, i.e inside the bowl. The steep sides. Of the bowl mean that a missile is either clearly inside the bowl, or clearly outside. Thus a player may score (minor) points for landing a missile in the bowl. (As mentioned, a near-miss might shake the bowl and bottle, but it does not dislodge the cap.)

In an alternative construction, the bowl is provided with a large flat annular rim, whereby three categories of scoring may be provided: i.e landing on the rim of the bowl; landing inside the bowl; and of course major points for knocking the cap off. When each round of the game is completed, the players can count up their scores and collect up the missiles for the next round.

The game apparatus as described can easily be stowed, e.g in a cupboard, over the winter, and its deep bowl shape means that the loose or separate pieces are very well contained, and unlikely to become lost. This aspect may be contrasted with other garden-game apparatuses that have separate pieces.

Preferably, the missiles are identical to the cap. In that case, the loose pieces of the game apparatus are all the same. Therefore, even if one or a small number of the cap/missile pieces does become lost, the game can still be played. The cap/missile pieces are large, so they are unlikely to be lost.

The disk-like configuration of the missile means that the missile, unlike say a ball, can be thrown in many different ways. Different players are free to develop skills using different throwing techniques. Similarly, the cap resting on the bottle (being identical to the missile) is affected, as to the ease with which it can be dislodged, by the attitude and orientation of the missile at the moment of impact—again, unlike say a ball.

The missiles may be moulded in different colours, for ease of identification for scoring. The missile that is to serve as the cap may be selected at random, each round, or can be of a particular colour. As mentioned, all the missiles are the same, as to size and shape, so any one of them can serve as the cap.

Figure 5:
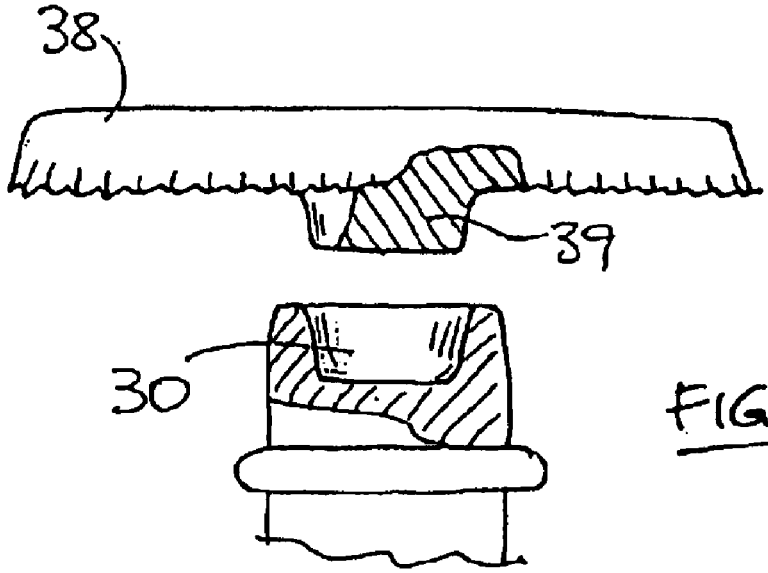
FIG. 5 is a view similar to FIG. 3, showing another manner in which the cap fits over the bottle.

In the alternative as shown in FIG. 5, the cap 38 is provided with a stud 39, which is a tight fit inside the hollow 30 of the top rim 28 of the bottle 24. This may be contrasted with the cap 25 which has the recess 26, which is designed to fit outside, rather than inside, the top rim of the bottle.

In an alternative embodiment, the cap is attached to the bottle by hook-and-loop fasteners (such as VELCRO—trademark), the separable elements of which are secured (e.g by adhesive) respectively to the cap and bottle.

In another alternative embodiment, the cap is attached to the bottle by magnets.

Figure 6:
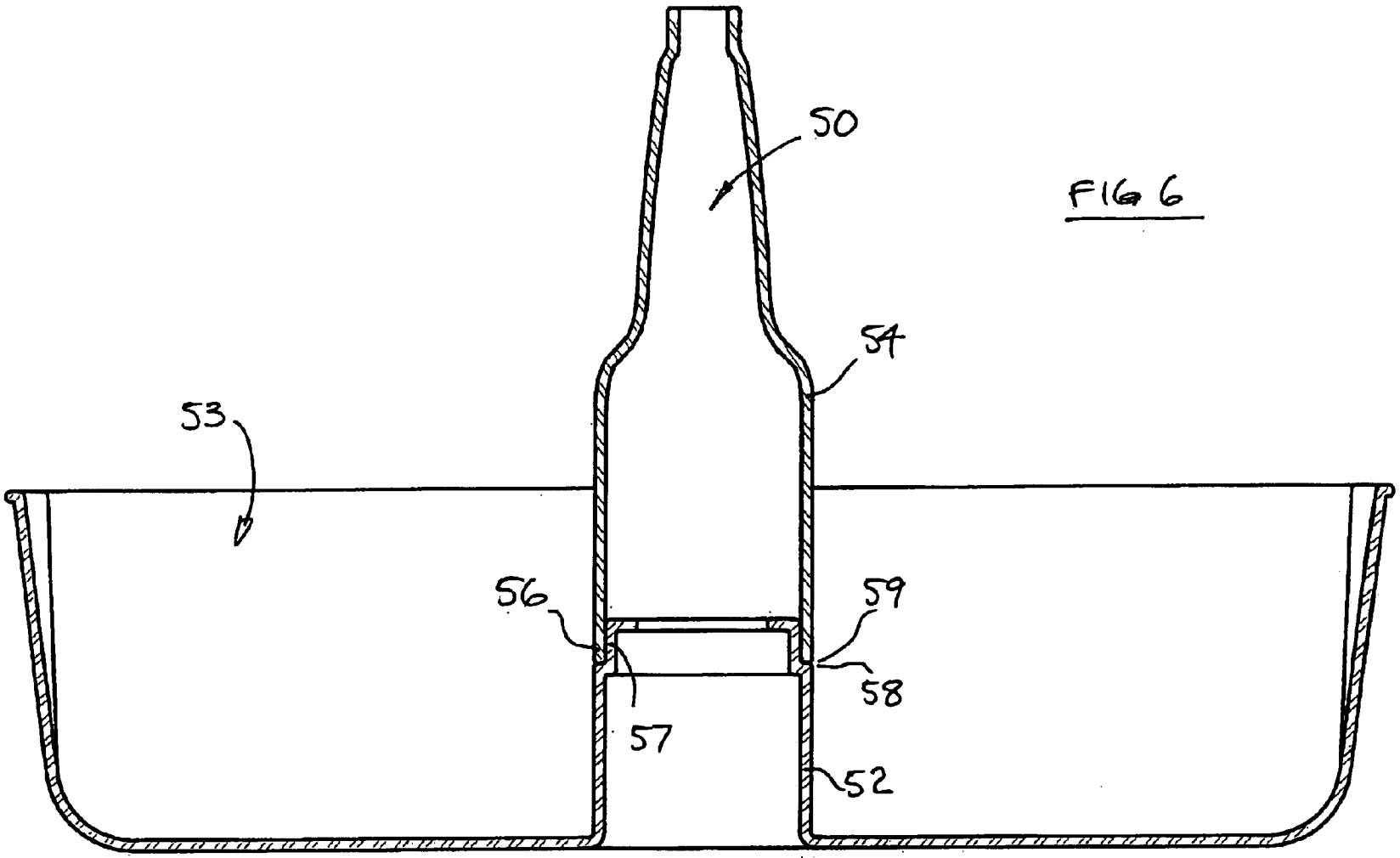
FIG. 6 is a cross-section showing another manner of forming the bottle.

FIG. 6 shows an alternative design, in which the simulated bottle 50 is in two portions. The bottom portion 52 of the bottle is moulded in one piece with the bowl 53. The top portion 54 is formed separately. The portions are dimensioned so that the top portion 54 fits tightly onto the bottom portion 52, to the extent that the portions cannot be knocked apart by a blow from the missile. On the other hand, upon deliberately pulling the bottle portions 52,54 apart, a person can quickly separate them.

The top portion 54 has a skirt 56, which engages a spigot 57 atop the bottom portion 52 of the bottle over a length of about half an inch. The shoulder 58 between the bottom portion 52 and the spigot 57 serves as an abutment for the lowermost edge 59 of the top portion 54.

Preferably, the game apparatus includes two bowls, each with a simulated bottle. (The two bowls would be set one each at the ends of a playing area.) Especially when there are two bowls, it might be regarded that stowing and storing the two bowls might be rather troublesome. However, as shown in FIG. 7, the bowls 53,53' can be arranged to fit neatly one inside the other.

Figure 7:
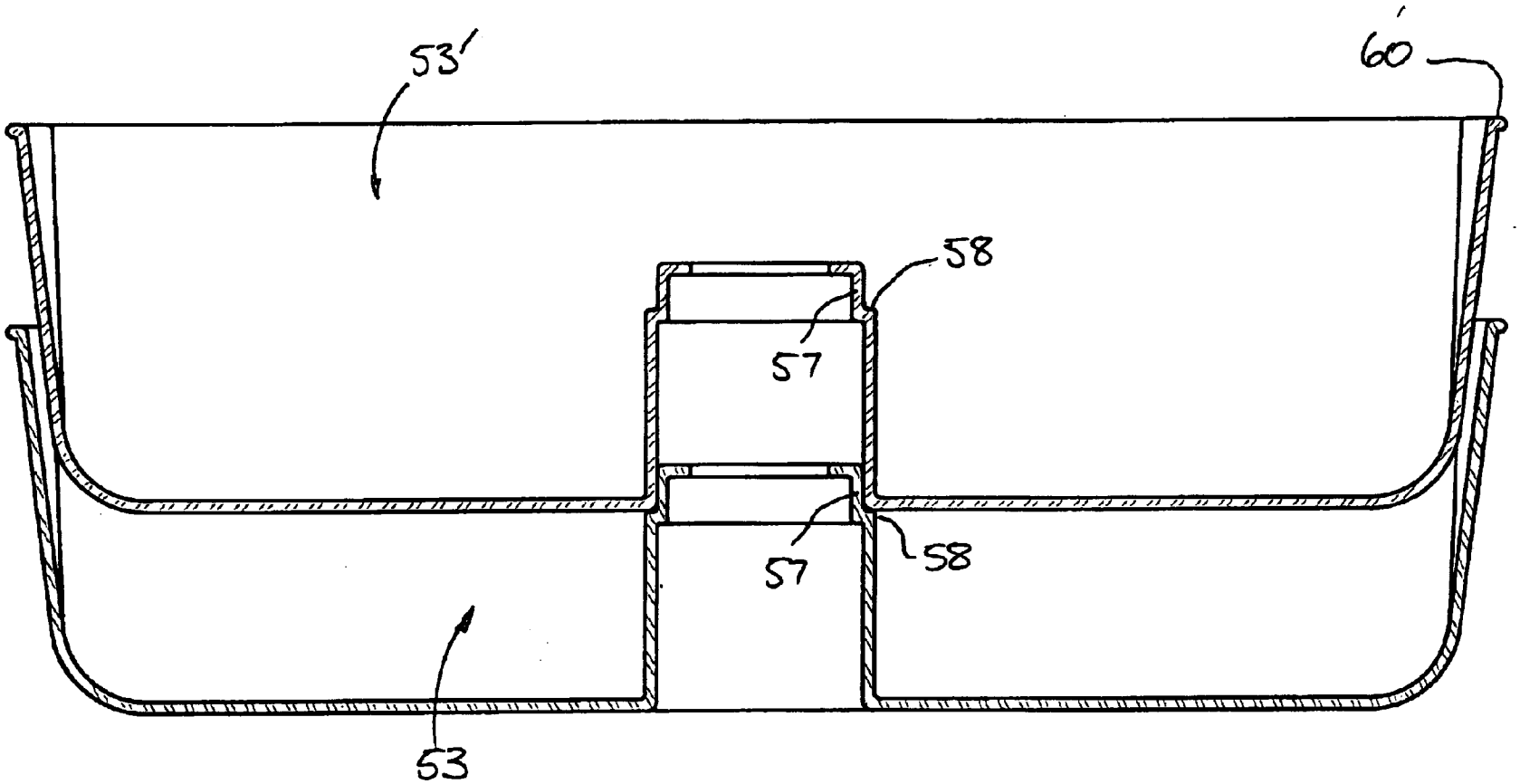
FIG. 7 is a cross-section showing a manner of stacking two of the bowls.

As shown in FIG. 7, the shoulder 58 is functional also as regards stacking the two bowls. For storage of the game apparatus, after a game session, the top portion 54 of the bottle 50 is removed. The shoulder 58 now serves as a support or rest for the junction between the floor 60 of the upper bowl 53' and the bottom portion 52 of the bottle 50.

The bottom portion 52 should be just high enough that, when the upper bowl 53' is placed on the lower bowl 53, the bowls are held far enough apart that there is no possibility of the bowls jamming together. The bowls need not be separated beyond that. Thus, when the simulated bottle 50 is made in two portions, the designer should set the length (height) of the bottom portion 52 from the standpoint that the bowls are held far enough apart, when the bowls are stacked, that the bowls do not become jammed together.

As shown, the assembled bottle 50 protrudes a good distance above the bowl-rim 60 of the bowl, whereby, if the bottle 50 were not dis-assemblable, stowage would be troublesome.

Even where the game apparatus comprises only one bowl and bottle set, still the bottle 50 preferably should be in two portions, for ease of stowage.

Figure 8:
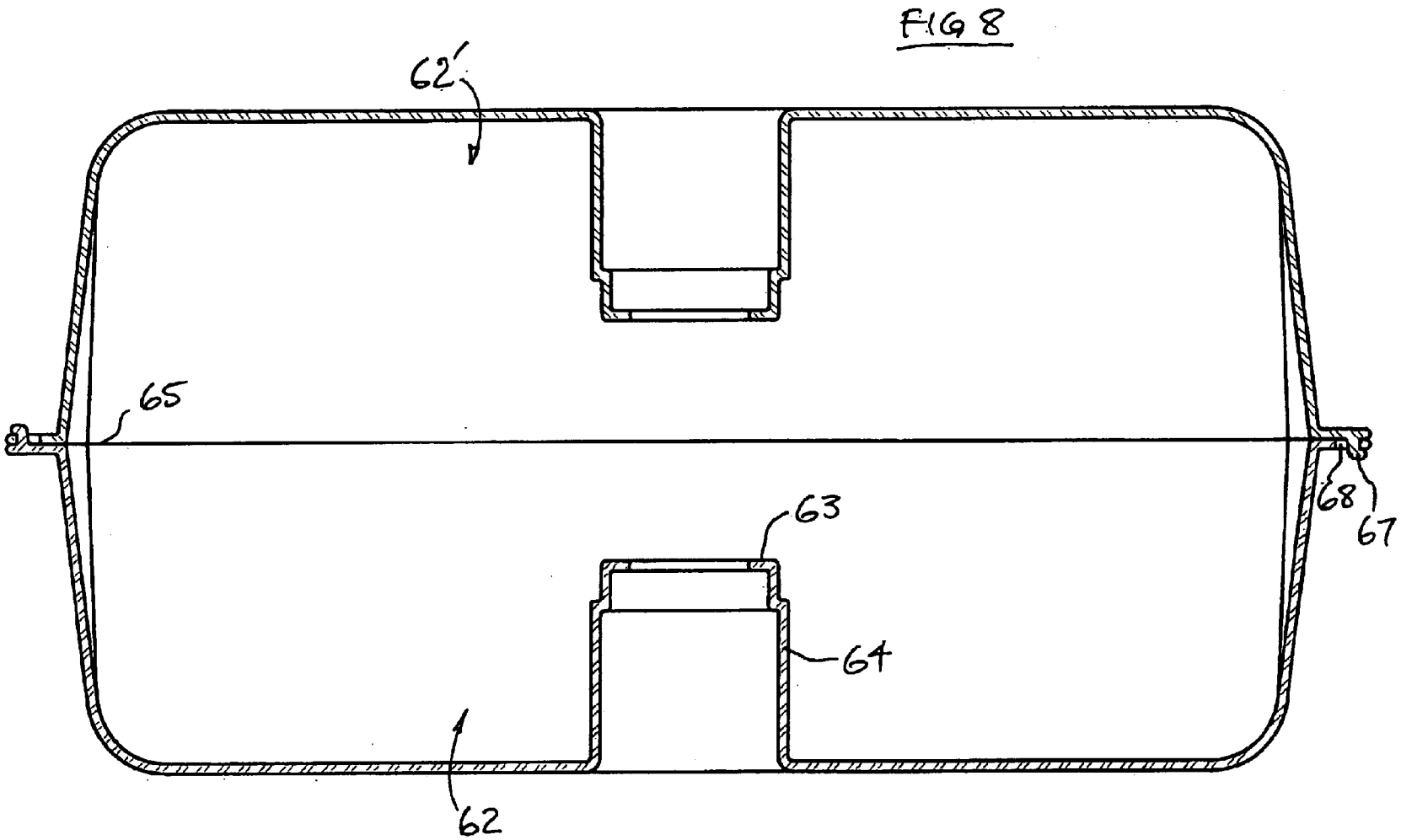
FIG. 8 is a cross-section showing another manner of stacking two of the bowls.

FIG. 8 shows how the two bowls 62,62' may be stacked, now in clam-shell fashion. Again, the bottle is in two portions, which can be separated for ease of storage when the apparatus is not in use. Now, the upper bowl 62' is up-turned, and placed over the lower bowl 62 like a lid. When the bowls are stacked like this, the topmost extent 63 of the bottom portion 64 should be below the bowl-rim 65, but need not be shorter than that.

In the FIG. 8 manner of stacking the bowls, the bowl-rims 65 of the (identical) bowls are moulded with suitable location-pegs 67, to keep the two bowls together. It is a simple matter for the designer to arrange for the location-pegs to engage suitable moulded-in sockets 68, to provide a catch for holding the two bowls together. The (injection-moulded) bowl is quite springy, and to release the catch it is arranged that the user simply presses on the sides of the bowls.

In the FIG. 8 manner of stowage, the missiles and the rest of the loose pieces of the apparatus are stored inside the chamber created between the two bowls, and this chamber is held closed by the catches holding the two bowls together. Thus, in FIG. 8, the possibility of the pieces becoming lost between games is minimal.

In FIG. 7, the loose pieces are stowed inside the upper bowl 53', which is open, and so the chances of the pieces becoming lost might be greater. On the other hand, the FIG. 8 arrangement takes up more vertical space than the FIG. 7 arrangement.

What is claimed is:

1. A game apparatus, wherein:

the apparatus includes a bowl-shaped receptacle, suitable for resting on the ground, having a bowl-floor;

the apparatus includes a post, preferably in the form of a bottle, having a top rim;

the game apparatus includes a cap;

the game apparatus includes at least one missile;

the missile is structurally suitable for being pitched or thrown, by hand, at the cap;

the post is attached to the bowl-floor in such manner as to be operatively integrated thereto;

the post lies in an upstanding configuration with respect to the bowl-floor;

the post includes a top rim;

an undersurface of the cap is suitably structured for engagement with, and removal from, the top-rim of the post;

the apparatus is so structured that, upon the cap being engaged with the top rim of the post, the resulting engagement is a tenacious engagement,which has such a degree of tenacity that the cap can be knocked off the post upon being struck by the missile, but that the cap substantially cannot be knocked off the post unless struck forcefully and directly by the missile; and the cap is much larger in diametral extent than the top rim of the post, to the extent that the cap, when placed on the top rim of the post, would fall off but for the tenacious engagement of the cap with the top rim.

2. Apparatus of claim 1, wherein:

one of the top rim of the post and the undersurface of the cap is formed with a stud, and the other is formed with a corresponding recess;

the stud and recess are dimensioned to be a tapering fit;

the fit is tapering in the sense that:

the stud is loose within the recess upon the stud being initially brought into engagement with the recess, but the stud becomes tight in the recess as the stud engages further into the recess;

the tightness of the fit increases as the stud is forced further into the recess; and the fit comprises the said tenacious engagement.

3. Apparatus of claim 2, wherein:

the fit that results from a person pressing the cap, by hand, down onto the post, and thereby pressing the stud into the recess, is termed a hand-tight fit; and the hand-tight fit comprises the said tenacious engagement of the cap onto the top rim of the post.

4. Apparatus of claim 1, wherein the missile is untethered and unguided in that, upon being thrown, the missile follows the trajectory as determined solely by the aim of the person throwing the missile.

5. Apparatus of claim 1, wherein the cap and the missile are identical as to shape and size, whereby the missile can serve as the cap and the cap can serve as the missile.

6. Apparatus of claim 1, wherein the game apparatus includes several missiles that are identical to the said missile as to shape and size.

7. Apparatus of claim 1, wherein the cap is proportioned generally as a flat disc.

8. Apparatus of claim 7, wherein the cap is at least five centimeters diameter.

9. Apparatus of claim 1, wherein the missile weighs at least seventy grams.

10. Apparatus of claim 1, wherein the bowl-shaped receptacle has steep sides, being so steep that the missile cannot come to rest on the steep sides, whereby the missile can only come to rest either clearly inside or clearly not inside the receptacle.

11. Apparatus of claim 1, wherein the post is moulded in plastic, and is secured in the centre of the bowl-shaped receptacle by a fastener.

12. Apparatus of claim 2, wherein:

one of the cap and the top rim of the post is formed with a second stud, and the other is formed with a second recess;

the arrangement of the apparatus is such that, as the said stud and recess are brought into mutual engagement, also the second stud and the second recess are brought into mutual engagement, upon the cap being engaged with the top rim of the post.

13. Apparatus of claim 1, wherein:

the post is in two portions, being a bottom portion and a top portion, and preferably the form of the post simulates a bottle;

the bottom portion is integral with floor of the bowl;

the top portion is adapted to be assamblable to, and dis-assemblable from, the bottom portion, by hand manipulation;

the bowl includes a bowl-rim, and, when the portions are assembled together, the top rim of the post lies a substantial distance above the bowl-rim;

and a topmost extremity of the bottom portion lies substantially below the bowl-rim.

14. Apparatus of claim 13, wherein the includes an identical second bowl and an identical second post, having respective top and bottom portions.

15. Apparatus of claim 14, wherein the two bowls are structured to be stacked together, clam-shell fashion, and to be clipped together, bowl-rim to bowl-rim.

16. Apparatus of claim 14, wherein the two bowls are structured to be stacked together, one inside the other.

17. A game apparatus, wherein:

the apparatus includes a bowl-shaped receptacle, suitable for resting on the ground, having a bowl-floor;

the apparatus includes a post, preferably in the form of a bottle, having a top rim;

the game apparatus includes a cap;

the game apparatus includes at least one missile;

the missile is structurally suitable for being pitched or thrown, by hand, at the cap;

the post is attached to the bowl-floor in such manner as to be operatively integrated thereto;

the post lies in an upstanding configuration with respect to the bowl-floor;

the post includes a top rim;

an undersurface of the cap is suitably structured for engagement with, and removal from, the top rim of the post;

the apparatus is so structured that, upon the cap being engaged with the top rim of the post, the resulting engagement is a tenacious engagement, which has such a degree of tenacity that the cap can be knocked off the post upon being struck by the missile, but that the cap substantially cannot be knocked off the post unless struck forcefully and directly by the missile; and the top rim of the post and the undersurface of the cap include magnetic materials, arranged so that the cap is retained on the top rim of the post by magnetic attraction, upon the cap being brought into engagement, by hand, with the post.

18. A game apparatus, wherein;

the apparatus includes a bowl-shaped receptacle, suitable for resting on the ground, having a bowl-floor;

the apparatus includes a post, preferably in the form of a bottle, having a top rim;

the game apparatus includes a cap;

the game apparatus includes at least one missile;

the missile is structurally suitable for being pitched or thrown, by hand, at the cap;

the post is attached to the bowl-floor in such manner as to be operatively integrated thereto;

the post lies in an upstanding configuration with respect to the bowl-floor; the post includes a top rim;

an undersurface of the cap is suitably structured for engagement with, and removal from, the top rim of the post;

the apparatus is so structured that, upon the cap being engaged with the top rim of the post, the resulting engagement is a tenacious engagement, which has such a degree of tenacity that the cap can be knocked off post upon being struck by the missile, but that the cap substantially cannot be knocked off the post unless struck forcefully and directly by the missile; and the top rim of the post and the undersurface of the cap include complementary hook-and-loop fastener elements, arranged so that the cap is retained on the top rim of the post thereby, upon the cap being brought into engagement, by hand, with the post.

* * * * *